US005504285A

United States Patent [19]

Castonguay et al.

[11] Patent Number: 5,504,285

[45] Date of Patent: Apr. 2, 1996

[54] CIRCUIT BREAKER INDICATING FLAG INTERLOCK ARRANGEMENT OPERATING SPRINGS

[75] Inventors: Roger N. Castonguay, Terryville; Mark A. Zaffetti, Windsor Locks; James L. Rosen, West Hartford, all of Conn.

[73] Assignee: General Electric Company, New York, N.Y.

[21] Appl. No.: 304,331

[22] Filed: Sep. 12, 1994

[51] Int. Cl.[6] ..... H01H 9/16; H01H 9/20

[52] U.S. Cl. ..... 200/50 R; 200/308

[58] Field of Search ..... 200/50 R, 50 A, 200/50 AA, 50 B, 50 C, 17 R–18, 308, 400, 401

[56] References Cited

U.S. PATENT DOCUMENTS

| | | | |
|---|---|---|---|
| 2,777,024 | 1/1957 | West | 200/50 A |
| 3,227,831 | 1/1966 | Jacks et al. | 200/50 A |
| 4,001,742 | 1/1977 | Jencks et al. | 200/401 X |
| 4,002,865 | 1/1977 | Kuhn et al. | 200/50 AA |
| 4,011,424 | 3/1977 | Ericson et al. | 200/308 |
| 4,017,698 | 4/1977 | Kuhn et al. | 200/50 AA |
| 4,301,342 | 11/1981 | Castonguay et al. | 200/308 X |
| 4,658,323 | 4/1987 | Dougherty et al. | 361/79 |
| 4,801,907 | 1/1989 | Kelaita et al. | 335/20 |

*Primary Examiner*—J. R. Scott
*Attorney, Agent, or Firm*—Richard A. Menelly

[57] ABSTRACT

This invention relates to a high ampere-rated circuit breaker which meets the electrical code requirements of the world market. The charging of the powerful operating springs controlling the circuit breaker contacts is made manually by a ratchet and pawl assembly. A logic plate interacts with the operating springs charging gear and a logic lever interacts with the ratchet and pawl assembly to prevent the charge indicating flag from signaling until the operating springs have become fully charged.

17 Claims, 4 Drawing Sheets

CIRCUIT BREAKER INDICATING FLAG INTERLOCK ARRANGEMENT OPERATING SPRINGS

BACKGROUND OF THE INVENTION

U.S. Pat. No. 4,001,742 of 04 Jan. 1977 entitled "Circuit Breaker Having Improved Operating Mechanism" describes a circuit breaker capable of interrupting several thousand amperes of circuit current at several hundred volts potential. As described therein, the operating mechanism controls the powerful operating springs that open and close the circuit breaker contacts. Once the operating mechanism has responded to separate the contacts, the operating springs must be recharged to supply sufficient motive force to the movable contact arms that carry the contacts.

U.S. patent application Ser. No. 08/214,522 of 3 Mar. 1994 entitled "Handle Operator Assembly for High Ampere-rated Circuit Breaker" describes an assembly for manually charging the circuit breaker contact closing springs. U.S. patent application Ser. No. 08/218,287 of 28 Mar. 1994 entitled "Latching Arrangement for High Ampere-rated Circuit Breaker" describes the latching arrangement used to retain the powerful operating mechanism springs from driving the circuit breaker contacts to the open position.

The interlock arrangement for interlocking the circuit breaker closing springs used within the circuit breakers described within the aforementioned U.S. Patent Applications is disclosed within U.S. patent application Ser. No. 08/266,409 of 6 Jun. 1994 entitled "Sequential Closing Interlock Arrangement for High Ampere-rated Circuit Breakers". U.S. patent application Ser. No. 08/203,062 of 28 Feb. 1994 entitled "Rating Module for High Ampere-Rated Circuit Breaker" describes the use separate pairs of operating springs for opening and closing the circuit breaker contacts.

Indication of the condition of the circuit breaker contact closing springs is made by means of a charge indicating flag arranged on the top surface of the circuit breaker cover.

One purpose of this invention is to provide a means for latching the circuit breaker charge indicating flag with the closing springs charging assembly whereby the charge indicating flag is held from indicating that the closing springs are fully charged unless and until the closing springs charging cycle is completed.

SUMMARY OF THE INVENTION

The charging springs indicating flag is interlocked by means of a logic plate that interacts with the operating springs charging gear and by means of a logic lever that interacts with the ratchet and pawl assembly to prevent the charge indicating flag from signaling until the operating springs have become fully charged.

DESCRIPTION OF THE PREFERRED EMBODIMENT

Figure 1:
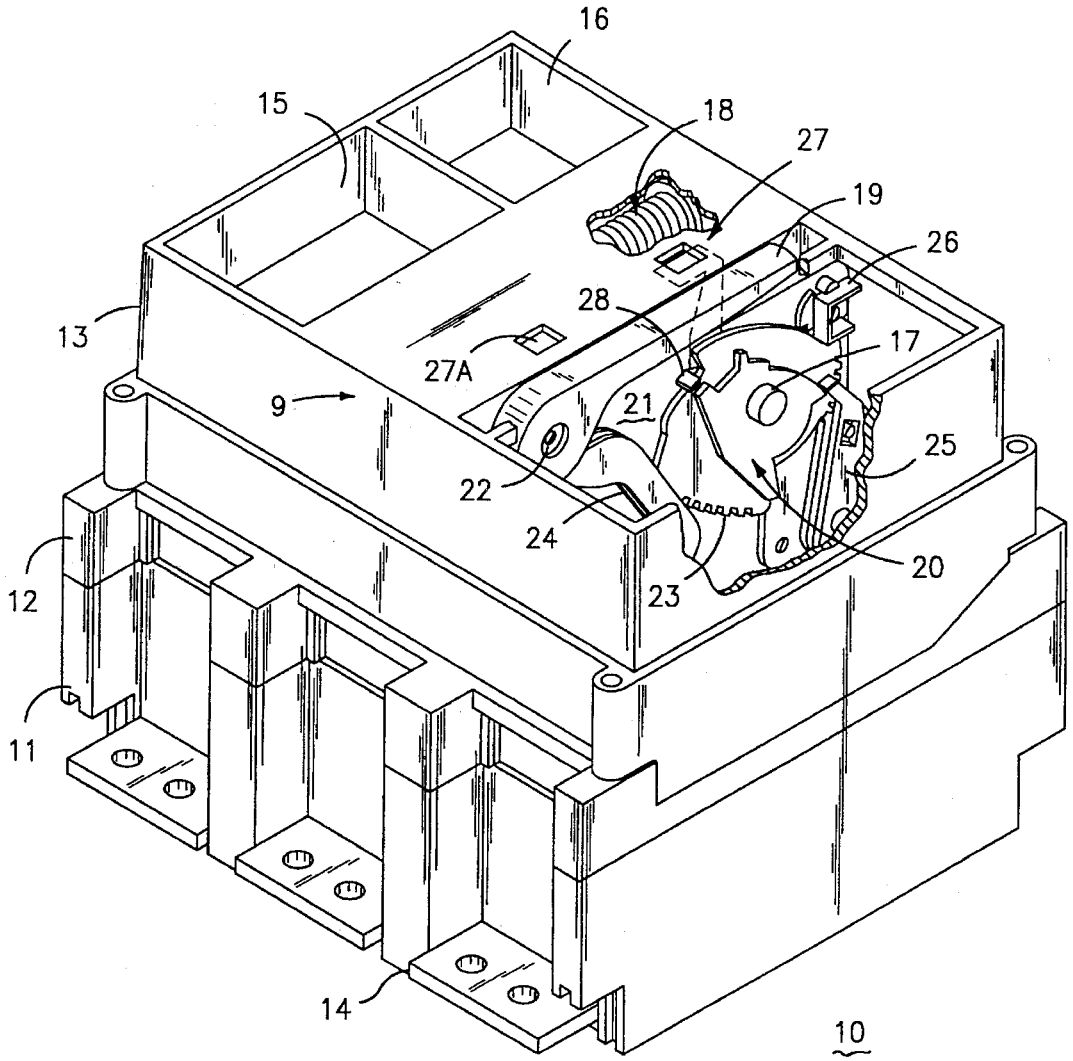
FIG. 1 is a top perspective view of a high ampere-rated circuit breaker with a portion of the circuit breaker cover removed to depict the charging springs indicating flag latching assembly according to the invention.
Figure 2:
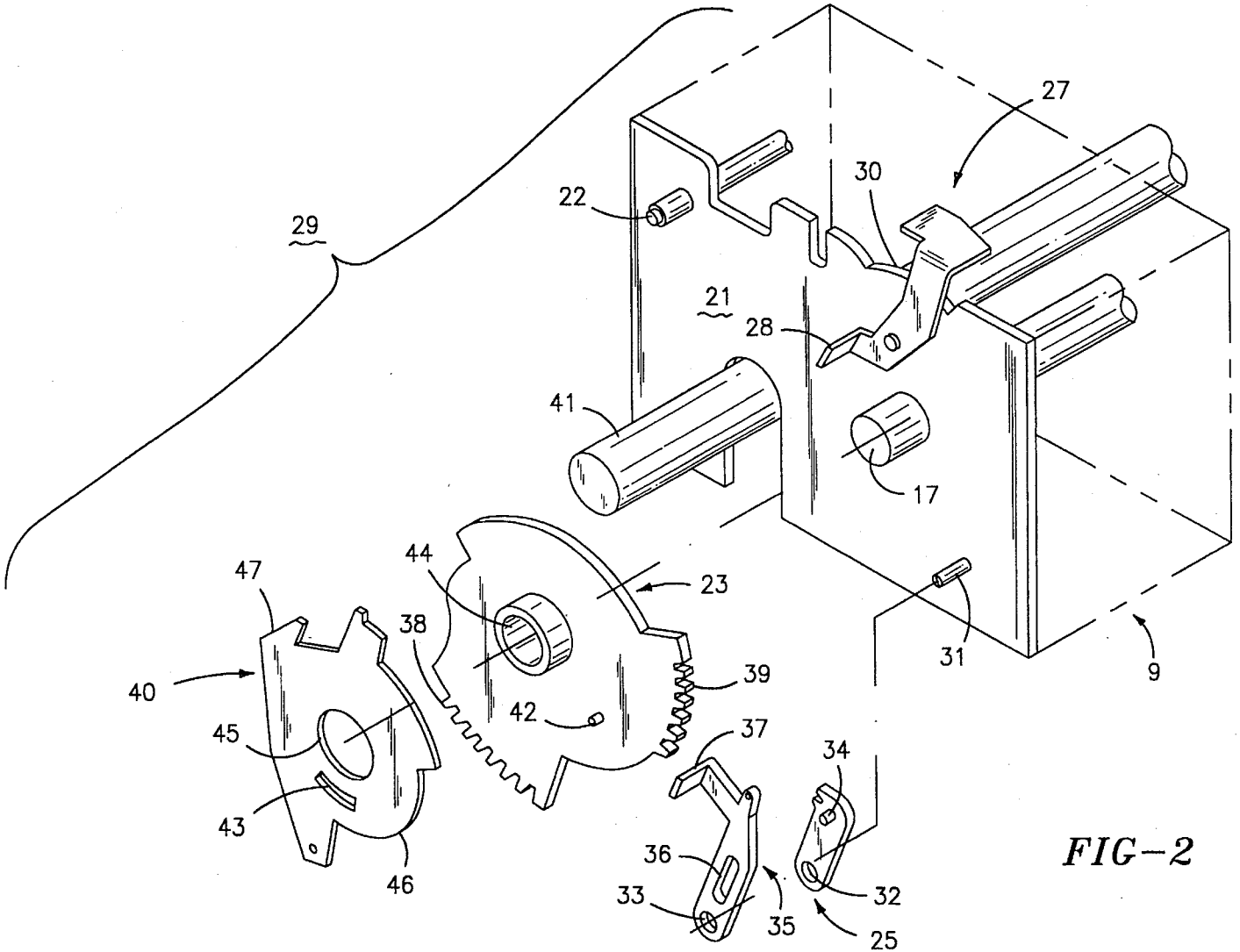
FIG. 2 is an enlarged top perspective view of the indicating flag latching assembly of FIG. 1 with the components in isometric projection.

The high ampere-rated circuit breaker 10 shown in FIG. 1 is capable of transferring several thousand amperes quiescent circuit current at several hundred volts potential. The circuit breaker consists of an electrically insulated base 11 to which an intermediate cover 12 of similar insulative material is attached prior to attaching the top cover 13, also consisting of an electrically-insulative material. Electrical connection with the interior current-carrying components is made by load terminal straps 14 extending from one side of the base and line terminal straps (not shown) extending from the opposite side thereof. The interior components are controlled by an electronic trip unit contained within a recess 15 on the top surface of the top cover 13. Although not shown herein, the trip unit is similar to that described within U.S. Pat. No. 4,658,323 and interacts further with an accessory contained within the accessory recess 16 to provide a range of protection and control functions such as described, for example within U.S. Pat. No. 4,801,907 of 31 Jan. 1989. The operating mechanism as described within the U.S. patent application Ser. No. 08/203,062 entitled "Rating Module Unit for High Ampere Rated Circuit Breakers includes a closing shaft 17 which provides the forces required to charge the powerful operating mechanism closing springs 18 within the spring charging compartment 9. The operating handle 19 allows manual operation of the circuit breaker operating mechanism as well as providing manual means for charging the operating mechanism springs through operation of the handle drive assembly 20. The handle is attached to the operating mechanism sideframe 21 by means of the handle pivot pin 22 and is connected with the handle drive gear 23 by a pair of handle drive links 24. The handle drive gear interacts with a locking pawl 25 to restrain the handle drive gear from reverse rotation during the operating spring charging process as described in the aforementioned U.S. patent application Ser. No. 08/214,522. The latch assembly 26 restrains the operating mechanism from responding when the closing springs have become fully charged. To turn on the circuit breaker by moving the circuit breaker contacts within the base to the closed condition, the closing button 27A is depressed to release the closing springs. The indicating flag 27 which is associated with the closing button interacts with the handle drive assembly 20 by means of a tab 28 in the manner best seen by now referring to the indicating flag interlock assembly 29 depicted in FIG. 2 as follows.

The sidearm 21 is shown outside the circuit breaker to illustrate the arrangement of the indicating flag 27 relative to the handle pivot pin 22, operating mechanism drive shaft 41 and the closing shaft 17. After assembling the handle drive gear 23 on the closing shaft 17 by means of the thru-hole 44 and positioning the tab 28 on the end of the indicating lever 30 on the indicating flag 27, the logic plate 40 is then positioned on the drive gear under the tab 28 by means of the thru-hole 45. The locking teeth 39 are arranged to the right of the drive gear with the charging teeth 38 to the left as viewed in FIG. 2. The post 42 on the drive gear extends within the slot 43 on the logic plate with the tab 28 positioned on the stop 47 formed on the outer perimeter of the logic plate. The locking pawl 25 and the logic lever 33 are supported on the pivot pin 31 extending from the side frame 21 by means of the thru-holes 32, 33. The post 34 on the pawl extends through the slot 36 formed in the logic lever 35 and the off-set tab 37 extending from the logic lever is positioned on the dwell cam surface 46 formed on the outer perimeter of the logic plate. The operation of the indicating flag interlock assembly 29 is best seen by referring to the handle drive assemblies 20 shown in FIGS. 3 and 4.

Figure 3:
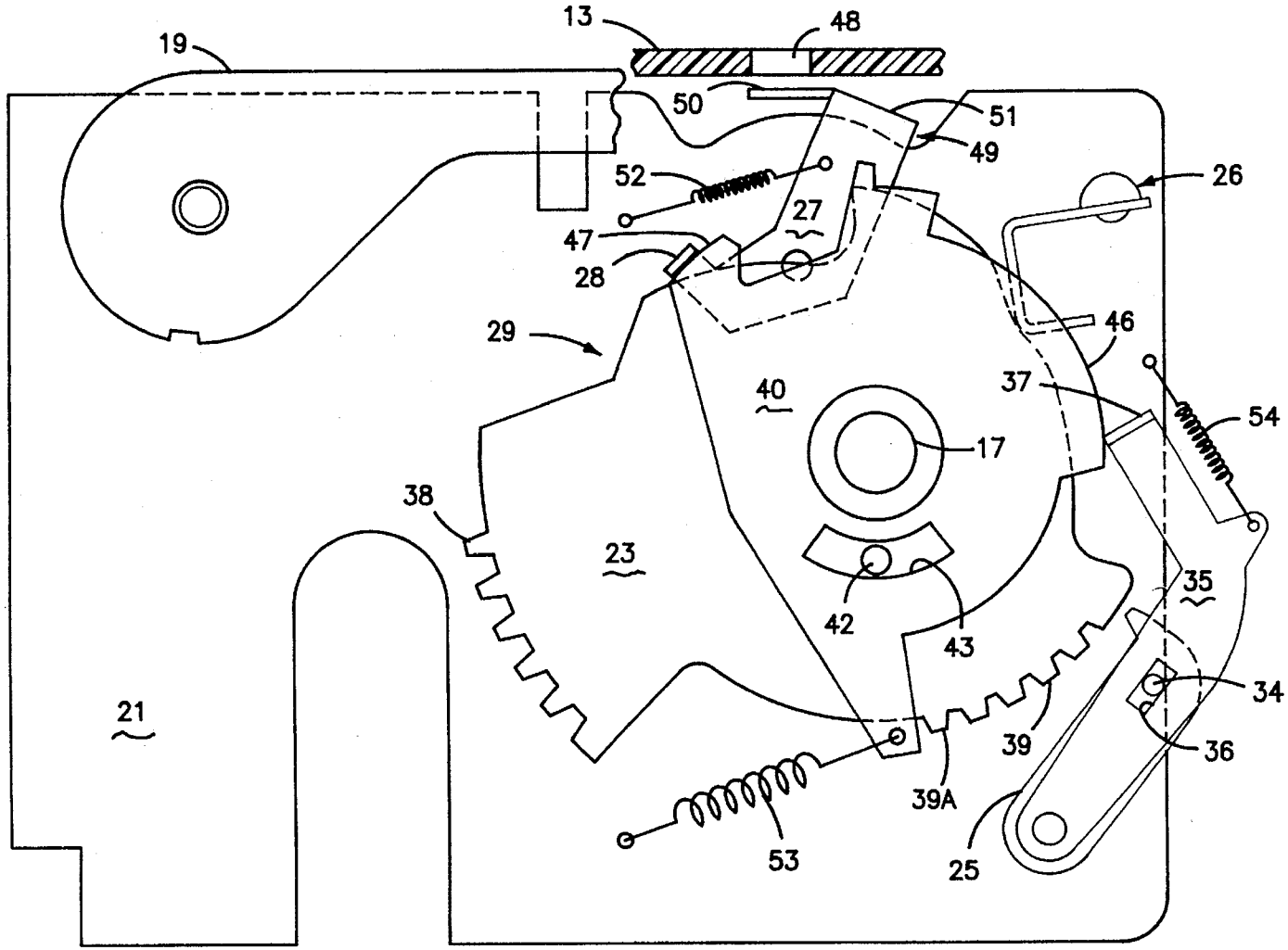
FIG. 3 is an enlarged plan side view of the indicating flag latching assembly of FIG. 1 with the circuit breaker closing springs in a discharged condition.
Figure 4:
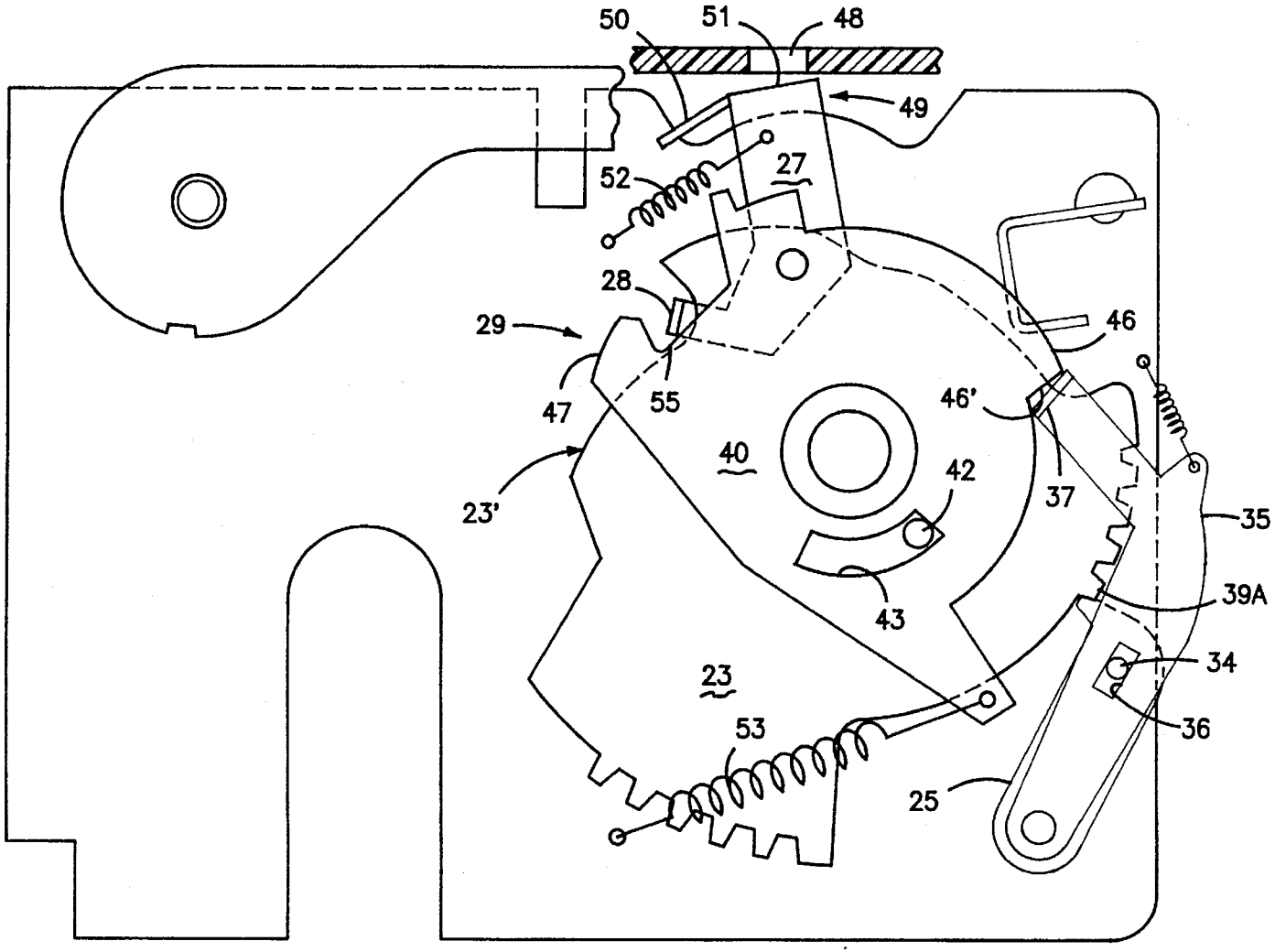
FIG. 4 is an enlarged plan side view of the indicating flag latching assembly of FIG. 1 with the circuit breaker closing springs in a fully-charged condition.

The interlock assembly 29 on the side frame 21 is shown in the discharged condition in FIG. 3 such that the DISCHARGED indicating part 50 of the top plate 49 on the indicating flag 27 is visible under the viewing window 48 formed in the top cover 13 and the CHARGED indicating part 51 is away from the viewing window. With the tab 28 on the end of the indicating flag 27 positioned on the outer cam surface 47 of the logic plate 40 within the interlock assembly 29 of FIG. 3, the flag is kept from rotating against the return bias provided by the extended flag spring 52. During the charging of the closing springs, the handle 19 is operated to engage the charging teeth 38 and rotate the closing shaft 17 extending from the spring charging compartment 9 and the drive gear 23 counterclockwise driving the locking teeth 39 under the locking pawl 25. Until the last tooth 39A of the locking teeth has passed under the locking pawl, the post 42 is away from the edge of the slot 43 in the logic plate 40 and the logic plate spring 53 remains uncharged. The off-set tab 37 on the logic lever 35 remains positioned on the dwell cam surface 46 on the logic plate against the return bias force exerted by the extended logic lever spring 54. Due to the capture of the post 34 within the slot 36 in the logic lever 35, the logic lever follows the position of the pawl 25 and is thereby held against the return bias force. During the entire charging process, the latch assembly 26 prevents release of the circuit breaker operating mechanism in the manner described within the earlier referenced U.S. patent application Ser. No. 08/214,522.

Before the last tooth 39A has passed under the locking pawl 25, the post 42 on the drive gear 23 contacts the edge of the slot 43 on the logic plate 40 driving the logic plate counterclockwise against the return bias of the extended logic plate spring 53, thereby sliding surface 46 out of contact with the tab 37 on the logic lever 35 due to the engagement of the pin 34 with the edge of the logic lever slot 36. The logic lever 35 is maintained in the position shown in FIG. 3 until the last tooth 39A passes under the locking pawl 25. When the locking pawl drops behind the last tooth 39A, the closing spring 18 (FIG. 1) is fully-charged and the logic lever 35 is able to rotate in a counter-clockwise direction under the urgence of the logic lever spring 54. The tab 37 engages the surface 46' on the logic plate 40 thereby rotating the logic plate 40 in a counter-clockwise direction at the same time, sliding the tab 28 on the indicating flag 27 away from the stop 47 on the perimeter of logic plate allowing the tab 28 to drop within the slot 55 on the perimeter of the logic plate. The indicating flag 27 rotates under the bias force of the indicating flag bias spring 52 to the fully charged condition depicted in FIG. 4. The DISCHARGED part 50 on the top plate 49 rotates away from the viewing window 48 as the CHARGED part 51 rotates thereunder.

Upon subsequent release of the closing spring 18, the drive gear 23 rotates in the clockwise direction moving the surface 23' on the drive gear against the tab 28 on the indicating flag 27 and rotating the indicating flag in the clockwise direction thus rotating the CHARGED part 51 on the top plate 49 away from under the viewing window 48 and positioning the DISCHARGED part 50 thereunder. The contacting of the tab 28 by the surface 23' also allows the logic plate 40 to rotate clockwise under the urgence of the logic plate spring 53 and position the surface 47 under the tab 28 as shown earlier in FIG. 3.

A logic sensing arrangement associated with the circuit breaker charging springs has herein been described whereby the charge indicating flag is interlocked to deter CHARGED indication until and unless the charging springs are fully charged.

We claim:

1. A circuit breaker for high ampere-rated circuit interruption comprising:

an insulative base 11;

an insulative cover 13 above said base, said cover enclosing a closing shaft 17 and a drive shaft 41 extending from an operating mechanism sideframe 21;

a closing spring 18 interacting with said closing shaft, said closing spring receiving forces for moving said spring into a charged condition; by an externally accessible operating handle 15 connecting with said closing shaft through a handle drive gear 18 and a locking pawl 22 allowing an operator to provide said forces;

an indicating flag 27 providing indication of charged and uncharged conditions of said closing spring; and a logic plate 40 arranged on said drive gear on said closing shaft and interacting with said drive gear and said indicating flag to prevent said indicating flag from operation until said closing spring has become fully charged.

2. The circuit breaker of claim 1 including a logic lever 35 on said locking pawl, said logic lever contacting a cam surface on said logic plate to prevent said indicating flag from operation until said closing spring has become fully charged.

3. The circuit breaker of claim 1 including a logic lever slot 36 in said logic lever and a locking pawl post 42 extending from said locking pawl, said locking pawl post being captured in said logic lever slot to move said logic lever in unison with said locking pawl.

4. The circuit breaker of claim 1 including a logic plate slot 43 in said logic plate, and a drive gear post 42 extending from said drive gear, said drive gear post being captured within said logic plate slot for controlled rotation of said logic plate.

5. The circuit breaker of claim 4 wherein said drive gear includes locking teeth 39 on a perimeter thereof, interacting with said locking pawl for preventing reverse rotation of said drive gear while said closing spring is being charged.

6. The circuit breaker of claim 5 wherein said locking pawl releases said locking teeth and drives said logic lever away from said cam surface when said closing spring is fully charged.

7. The circuit breaker of claim 5 wherein said drive gear post contacts an edge of said logic plate slot when said closing spring is fully charged and rotates said drive gear out of contact with said indicating flag to allow rotation of said indicating flag.

8. The circuit breaker of claim 5 wherein said circuit breaker cover includes a viewing window 48 and said indicating lever includes a top plate 49, said top plate including CHARGED and DISCHARGED indicia 51, 50 thereon.

9. The circuit breaker of claim 8 wherein said CHARGED indicia underlie said viewing window when said drive gear is in contact with said indicating lever and said DISCHARGED indicia underlie said viewing window when said indicating lever is free of contact with said drive gear.

10. An indicating flag interlock arrangement for high ampere-rated circuit breakers comprising in combination:

an indicating flag 27 providing indication of charged and uncharged conditions of a circuit breaker closing spring 18; and a logic plate 40 arranged on a circuit breaker drive gear 23 on a circuit breaker closing shaft 17 and interacting with said drive gear and said indicating flag to prevent said indicating flag from operation until said closing spring has become fully charged.

11. The indicating flag interlock arrangement of claim 10 including a logic lever 35 on a circuit breaker locking pawl, said logic lever contacting a cam surface on said logic plate to prevent said indicating flag from operation until said closing spring has become fully charged.

12. The indicating flag interlock arrangement of claim 11 including a logic lever slot 36 in said logic lever and a locking pawl post 42 extending from said locking pawl, said locking pawl post being captured in said logic lever slot to move said logic lever in unison with said locking pawl.

13. The indicating flag interlock arrangement of claim 12 wherein said drive gear includes locking teeth 39 on a perimeter thereof, interacting with said locking pawl for preventing reverse rotation of said drive gear while said closing spring is being charged.

14. The indicating flag interlock arrangement of claim 13 wherein said drive gear post contacts an edge of said logic plate slot when said closing spring is fully charged and rotates said drive gear out of contact with said indicating flag to allow rotation of said indicating flag.

15. The indicating flag interlock arrangement of claim 14 wherein said locking pawl releases said locking teeth and drives said logic lever away from said cam surface when said closing spring is fully charged.

16. The indicating flag interlock arrangement of claim 15 wherein said circuit breaker cover includes a viewing window 48 on a circuit breaker cover 13 and wherein said indicating lever includes a top plate 49, said top plate including CHARGED and DISCHARGED indicia 51, 50 thereon.

17. The indicating flag interlock arrangement of claim 16 wherein said CHARGED indicia underlie said viewing window when said drive gear is in contact with said indicating lever and said DISCHARGED indicia underlie said viewing window when said indicating lever is free of contact with said drive gear.

* * * * *